United States Patent [19]

Swain et al.

[11] Patent Number: 4,533,299

[45] Date of Patent: Aug. 6, 1985

[54] VARIABLE CAPACITY WOBBLE PLATE COMPRESSOR WITH PROMPT CAPACITY CONTROL

[75] Inventors: James C. Swain; David L. Thomas, both of Columbus, Ohio

[73] Assignee: Diesel Kiki Co., Ltd., Tokyo, Japan

[21] Appl. No.: 608,566

[22] Filed: May 9, 1984

[51] Int. Cl.[3] ..... F04B 1/26

[52] U.S. Cl. ..... 417/222; 417/270

[58] Field of Search ..... 417/218, 222, 270; 62/226

[56] References Cited

U.S. PATENT DOCUMENTS

| | | | |
|---|---|---|---|
| 3,959,983 | 1/1976 | Roberts | 62/226 |
| 4,073,603 | 2/1978 | Abendschein | 417/222 |
| 4,145,163 | 3/1979 | Fogelberg | 417/222 |
| 4,475,871 | 10/1984 | Roberts | 417/222 |
| 4,480,964 | 11/1984 | Skinner | 417/270 |
| 4,492,527 | 1/1985 | Swain | 417/222 |

*Primary Examiner*—William L. Freeh

*Attorney, Agent, or Firm*—Charles S. McGuire

[57] ABSTRACT

A wobble plate compressor which is adapted to vary the angularity of the wobble plate during rotation in response to the difference between the resultant reaction force exerted by the pistons on their compression and suction strokes and the pressure in the crankcase. The compressor has a passage with an orifice communicating a lower pressure space therein with the interior of the crankcase, a communication passage communicating a higher pressure space therein with the interior of the crankcase, and a control valve means for controlling the opening of the communication passage. Preferably, the cross-sectional area of the above orifice passage is set at such a value as to permit blow-by gas leaking from the cylinders into the crankcase to escape from the crankcase into the lower pressure space at a flow rate at least equal to the maximum possible flow rate at which the blow-by gas leaks from the cylinders into the crankcase.

11 Claims, 7 Drawing Figures

VARIABLE CAPACITY WOBBLE PLATE COMPRESSOR WITH PROMPT CAPACITY CONTROL

BACKGROUND OF THE INVENTION

This invention relates to variable capacity wobble plate compressors mainly adapted for use in air conditioning systems for automotive vehicles, and more particularly to an improved wobble plate compressor in which the crankcase pressure is controllable for varying the displacement or capacity of the compressor.

A variable capacity wobble plate compressor in general is adapted to vary its displacement or capacity through a change in the angularity of the wobble plate. It is known e.g. from U.S. Pat. No. 3,861,829 to vary the refrigerant pressure in the crankcase for changing the angularity or angle of inclination of the wobble plate relative to the drive shaft. A conventional wobble plate compressor of this type comprises a fluidtight housing, a drive shaft rotatably disposed in the housing, a cylinder block arranged in the housing and formed therein with a plurality of cylinders circumferentially arranged around the drive shaft and extending substantially parallel to the axis of the drive shaft, pistons received in the respective cylinders for reciprocating motions therein, and a wobble plate supported at its diametrically central portion by trunnion pins extending at right angles to the drive shaft and axially movable therealong and also supported at its peripheral edge by a pivot pin rotatable about the drive shaft together therewith. The wobble plate is adapted to be pivotally displaced in unison with axial movement of the trunnion pin along the drive shaft to have its angularity varied relative to the drive shaft. As the wobble plate rotates in a position inclined relative to the drive shaft, the pistons are reciprocatingly moved in their respective cylinders for pumping actions. In the compressor, the resultant reaction force exerted by all the pistons, (some on their compression strokes and some on their suction strokes) acts upon the wobble plate at a point inside a half portion of the circumference described by the axes of the cylinders, which is located at the same side of the drive shaft as the pistons on their compression strokes, so that the wobble plate is acted upon by the above resultant reaction force to become inclined relative to the drive shaft about the trunnion pins as a movable fulcrum during the pumping actions of the pistons. The resultant reaction force of the pistons counteracts the pressure in the crankcase which acts upon the pistons as back pressure. Therefore, when there occurs a drop in the pressure in the crankcase, the wobble plate is displaced in the angularity-increasing direction to increase the capacity, whilst when there occurs an increase in the crankcase pressure, the wobble plate is displaced in the angularity-decreasing direction to decrease the capacity.

In the above patented wobble plate compressor, a diaphragm valve is arranged across a line connecting the crankcase with a zone under lower pressure in the refrigerating circuit of an air conditioner, and operable in response to the refrigerant pressure in the line so that when a drop occurs in the line pressure due to a decrease in the thermal load on the refrigerating circuit, the diaphragm valve is displaced to restrict the communication between the interior of the crankcase and the lower pressure zone in the refrigerating circuit to reduce the flow rate of blow-by gas (which leaks into the crankcase through the gaps between the cylinders and the pistons) to the lower pressure zone through the line, resulting in an increase in the crankcase pressure. Consequently, the angularity of the wobble plate decreases to reduce the displacement of the compressor. On the contrary, when the refrigerant pressure in the line rises due to an increase in the thermal load on the refrigerating circuit, the crankcase pressure decreases to cause an increase in the angularity of the wobble plate to obtain increased displacement of the compressor.

Therefore, according to the above compressor patent, in the event that it is desired to suddenly reduce the displacement of the compressor (for instance, when it is desired to temporarily relieve an automotive engine associated with the compressor of the compressor load to use the total engine output for driving the automotive vehicle on which the engine is installed, in accelerating the vehicle or during running of same on an ascending slope) a stop valve (zero-stroke valve) which is arranged across the aforementioned line is closed to interrupt the communication between the crankcase and the lower pressure zone in the refrigerating circuit. However, an increase in the crankcase pressure depends solely on the leakage of blow-by gas through the gaps between the cylinders and the pistons into the crankcase, which takes place after the above interruption. This is disadvantageous in obtaining a sudden reduction of the capacity of the compressor.

OBJECTS AND SUMMARY OF THE INVENTION

It is a primary object of the invention to provide a variable capacity wobble plate compressor which enables very prompt cutting-off of the operation thereof by directly introducing high pressure from a higher pressure space into the crankcase.

It is another object of the invention to provide a variable capacity wobble plate compressor which has a single and simply-structured valve system for introducing high pressure from the higher pressure space into the crankcase.

It is a further object of the invention to provide a variable capacity wobble plate compressor which has a control means for automatically controlling the displacement in response to signals indicative of various parameters in a proper manner.

It is a further object of the invention to control the displacement accurately with a small dead-band. The use of on/off control valves rather than proportional control valves accomplishes this by continuallly varying the angularity of the wobble plate in small discrete motions which reduces the effect of friction in the mechanism.

A variable capacity wobble plate compressor according to the present invention comprises a first passage with an orifice communicating a lower pressure space in the compressor (suction manifold) with the crankcase of same for permitting escape of internal pressure in the latter into the former; a second passage communicating a higher pressure space in the compressor (discharge manifold) with the crankcase of same for introducing internal pressure in the former into the latter; and a control valve means for controlling the opening of the second passage. Preferably, the cross-sectional area of the orifice of the above first passage is set at such a value as to permit blow-by gas leaking into the crankcase through gaps between the cylinders and the pistons on their compression strokes to escape from the crankcase into the lower pressure zone at a flow rate at least equal to a maximum possible flow rate at which the blow-by gas leaks into the crankcase. Preferably, the above control valve means comprises an electromagnetic valve disposed to selectively close and open the above second passage and having a solenoid, the valve being responsive to the state of energization of said solenoid to selectively assume a position in which it fully closes the second passage and a position in which it fully opens same; a sensor means for sensing the angularity of the wobble plate; and electronic control means for producing a control signal for controlling the state of energization of the solenoid in response to an output signal from the sensor means and signals indicative of predetermined parameters.

Alternatively, the control valve means may comprise an electromagnetic valve disposed to selectively close and open the above second passage and having a solenoid, the valve being disposed to be displaced in its closing direction when the solenoid is energized; a feedback means for mechanically biasing the electromagnetic valve in its opening direction against the electromagnetic force of the solenoid, the feedback means having a mechanically biasing force thereof variable in response to the angularity of the wobble plate; and an electronic control means for controlling the solenoid. The electronic control means is adapted to produce a control signal for always keeping the solenoid energized during operation of the compressor while varying the degree of energization of the solenoid in response to signals indicative of predetermined parameters, whereby the electro-magnetic valve assumes either a fully opened position or a fully closed position in response to the biasing force of the feedback means and the degree of energization of the solenoid.

The above and other objects, features and advantages of the invention will be more apparent from the ensuing detailed description taken in conjunction with the accompanying drawings.

DETAILED DESCRIPTION

The invention will now be described in detail with reference to the drawings which show an embodiment of the invention.

Figure 1:
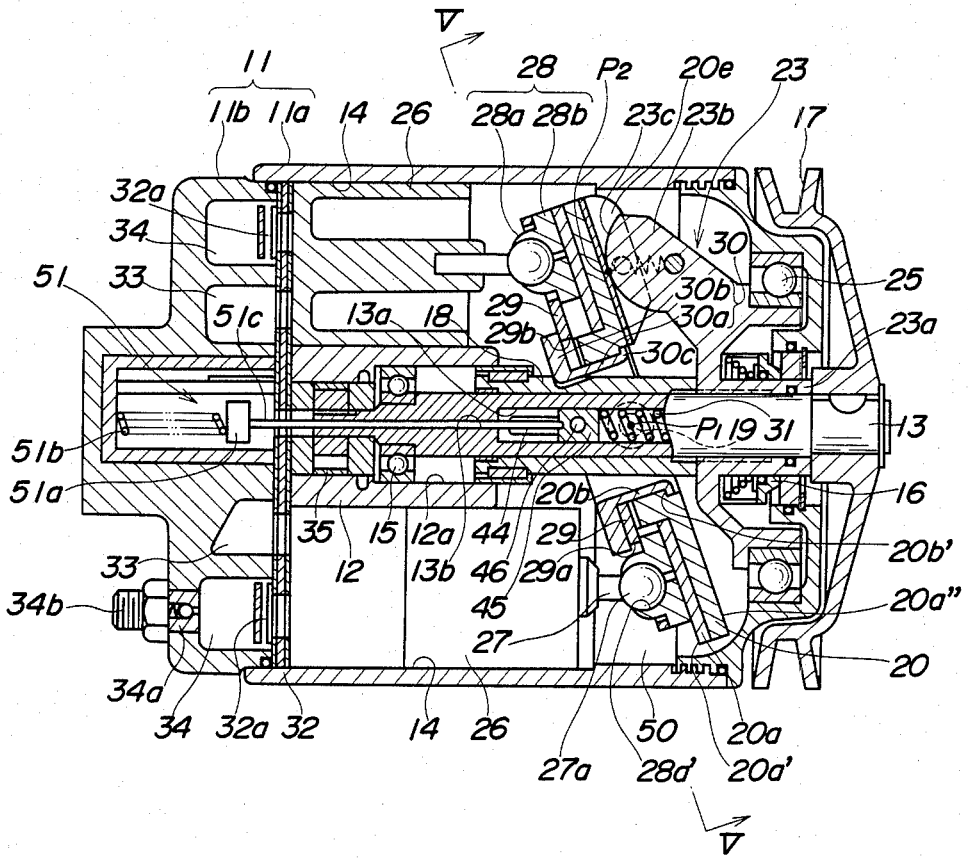
FIG. 1 is a horizontal longitudinal sectional view of a variable capacity wobble plate compressor according to an embodiment of the present invention.
Figure 2:
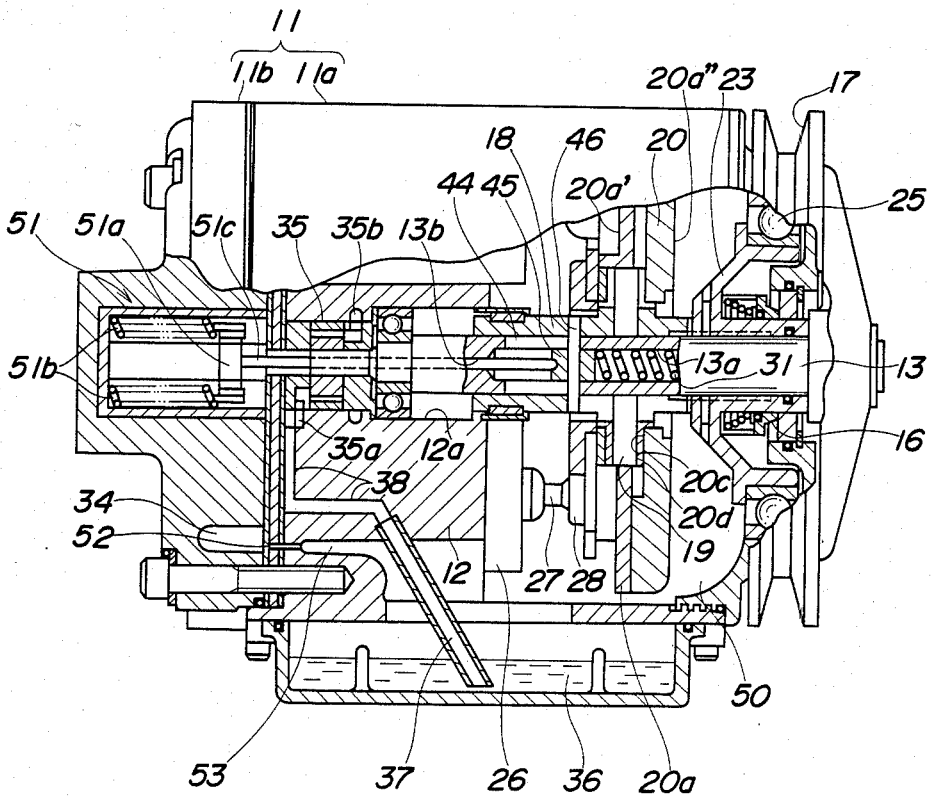
FIG. 2 is a vertical longitudinal sectional view of the same compressor.

Referring first to FIGS. 1 and 2, there is shown the whole construction of a variable capacity wobble plate compressor according to the invention. The compressor is described hereinbelow as applied to an air conditioning system for automotive vehicles. Reference numeral 11 designates a housing which is formed by a cylindrical casing 11*a* and a cylinder head 11*b* combined together. A cylinder block 12 is arranged within the cylindrical casing 11*a*, which is formed integrally with the casing 11*a* and formed therein with a plurality of cylinders 14 circumferentially arranged around a drive shaft 13 and extending substantially parallel to the axis of same. Pistons 26 are slidably received within respective ones of the cylinders 14. A crankcase 50 is defined in the housing 11 by an inner end of the cylinder block 12 and inner walls of the casing 11*a*. The drive shaft 13 is disposed substantially along the longitudinal axis of the housing 11, with its one end portion journalled by a ball bearing 15 mounted in a central bore 12*a* formed in the cylinder block 12. The other end portion of the drive shaft 13 extends through a boss 23*a* of an arm member 23 which has a radially obliquely extending arm 23*b*. The arm member 23 is journalled by a large-sized ball bearing 25 mounted in the casing 11*a*. Thus, the other end portion of the drive shaft 13 remote from the cylinder block 12 is supported by the casing 11*a* by means of the arm member 23 and the ball bearing 25. The same end portion of the drive shaft 13 remote from the cylinder block 12 further extends through a front end wall of the casing 11*a* on the right side as viewed in FIG. 1, with its tip exposed to the outside and carrying a pulley 17 rigidly fitted thereon. A sealing assembly 16 is fitted on the boss 23*a* of the arm member 23 to maintain air-tightness between the boss 23*a* and the casing ll*a*. The pulley 17 is connected by a driving belt to the output shaft of an engine installed in a vehicle, none of which is shown.

Figure 3:
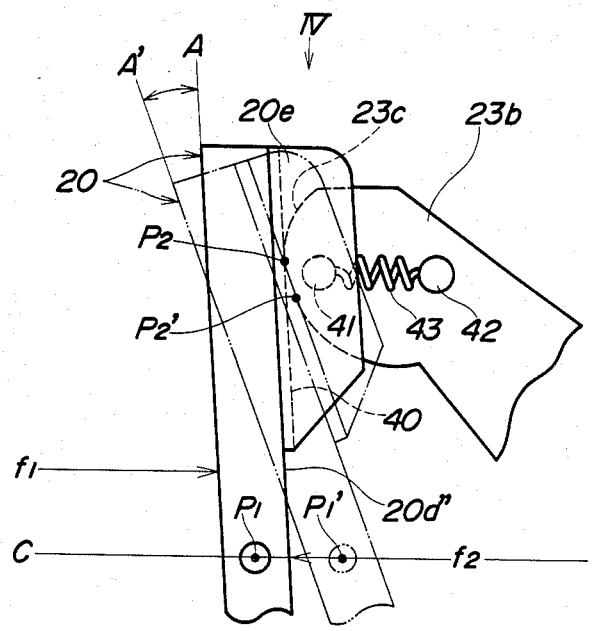
FIG. 3 is a schematic side view of the wobble plate and the second fulcrum forming essential part of the same compressor.
Figure 4:
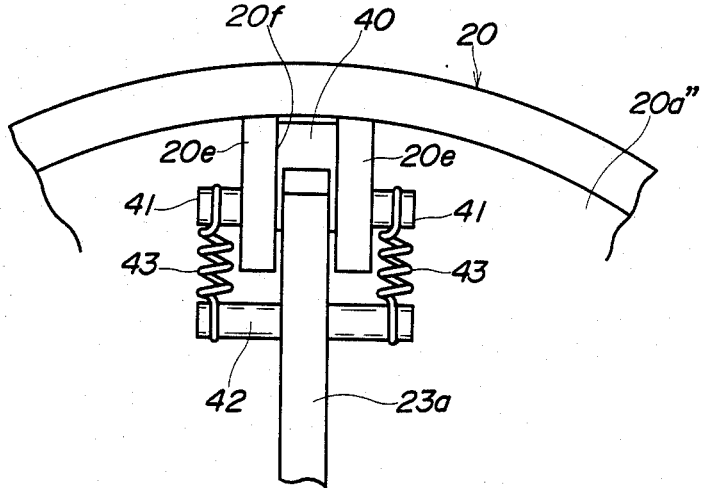
FIG. 4 is an end view as viewed in the direction of the arrow IV in FIG. 3.

A slider 18 in the form of a sleeve is fitted on an intermediate portion of the drive shaft 13 for axial sliding movement thereon, on which are secured a pair of trunnion pins 19 as a pivot extending at right angles to the drive shaft 13. A wobble plate 20 in the form of a disc is freely fitted on the slider 18 at its central through bore 20*b* and engages with the latter for pivoting about a first fulcrum or supporting point P1 formed by the trunnion pins 19 which are rotatably fitted, through collars 20*d*, in radial bores 20*c* formed in the inner peripheral wall of the central through bore 20*b* of the wobble plate 20. The arm 23*b* of the arm member 23 has a convex camming surface 23*c* having a generally semicircular cam profile, formed on its end face and disposed in contact with a side surface 20*a*″ of the wobble plate 20 remote from the cylinder block 12 at a predetermined location radially spaced from the drive shaft 13. The point of contact between the side surface 20*a*″ and the camming surface 23*c* forms a second fulcrum P2 for the wobble plate 20. Details of the fulcrum P2 and its peripheral parts are shown in FIGS. 3 and 4. The side surface 20*a*″ of the wobble plate 20 is formed thereon with a pair of guide protuberances 20*e* and 20*e* radially extending parallel with each other at predetermined locations and defining therebetween a gap 20*f* with a width nearly equal to the thickness 23*b* of the arm member 23, in which the tip of the arm 23*b* is engaged. The gap 20*f* has its bottom surface coated with a wear resisting material 40, and the camming surface 23*c* is disposed in contact with the wear resisting material 40 to form the second fulcrum P2. Thus, as the first fulcrum P1 formed by the trunnion pins 19 axially moves along the drive shaft 13, the wobble plate 20 is tilted about the first fulcrum P1 in a manner having its axial inclination varied relative to a vertical line to thus vary the displacement of the pistons 26. At the same time, the second fulcrum P2 radially moves along the guide protuberances 20*e*, 20*e* while it is prohibited from circumferential displacement by them. The compressor is so arranged that at the minimum angle of inclination of the wobble plate 20, the pistons 26 are allowed to make reciprocating motions through a stroke length equal to several percent of the maximum stroke length.

The first and second fulcrums P1, P2 are so located that irrespective of the angle of inclination of the wobble plate, each of the pistons 26 always starts its suction stroke motion nearly at an extreme end position in the cylinder 14 forming the top dead center of the piston.

Further, as shown in FIG. 3, the cam profile and radial position of the camming surface 23*c* are so set that as the wobble plate 20 becomes tilted from a minimum angularity position A, the second fulcrum P2 is radially inwardly displaced toward the axis C of the drive shaft 13 with a large amount of displacement, and at a maximum angularity position A′ of the wobble plate 20, the fulcrum P2 assumes a position P2′ closest to the axis C, and that the displacement P2—P2′ of the fulcrum P2 corresponding to tilting of the wobble plate 20 between the minimum and maximum angularity positions A, A′ is far larger than that of a conventional compressor of this kind.

A pair of pins 41 and 41 are fitted in opposite outer side surfaces of the parallel guide protuberances 20*e*, 20*e* and extend in opposite lateral directions with their axes aligned with each other, while a pin 42 is transversely fitted at its central portion through the arm 23*b* at a side of the pins 41, 41 remote from the wobble plate 20 and spaced from the same pins. Coiled springs 43 and 43 are connected between respective pairs of pins 41, 42 to maintain the side surface 20*a*″ of the wobble plate 20 in urging contact with the camming surface 23*c* of the arm 23*b* and thereby obtain positive engagement between the two members.

The camming engagement between the wobble plate 20 and the arm member 23 for causing displacement of the second fulcrum P2 relative to the axis C of the drive shaft 13 in response to a change in the angularity of the wobble plate 20 is not limited to the combination of a flat surface on the wobble plate 20 and a convex surface on the arm 23*b* as in the present embodiment. Any other combination of engaging surfaces with various profiles may be employed insofar as it can perform a camming function equivalent to the camming function of the present embodiment, for example, a combination of a convex surface on the wobble plate and a flat surface on the arm member, a combination of a concave surface on the wobble plate or the arm member and a convex surface on the other, etc.

The urging means or coiled springs 43, 43 for maintaining the side surface 20*a*″ of the wobble plate 20 and the camming surface 23*c* of the arm 23*b* in tight contact with each other may be omitted, if required, since the resultant reaction force exerted by the pistons 26 on compression strokes acts upon the wobble plate 20 in the direction of the camming surface 23*c*, which serves to obtain a similar engaging function to the above, during operation of the compressor.

The drive shaft 13 is formed therein along its axis with an axial hole 13*a* with a larger diameter extending in a portion of the drive shaft remote from the cylinder block 12 and another axial hole 13*b* with a smaller diameter extending continuously from an end of the axial hole 13*a* toward the cylinder block 12 and opening in a corresponding end face of the drive shaft 13. The drive shaft 13 has its peripheral wall formed therein with a pair of axially elongate slots 44 and 44 at diametrically opposite locations. An internal slider 45 is slidably fitted in the large-sized axial hole 13*a* and urged toward the cylinder block 12 by a coiled spring 31 disposed in the same hole. A cross pin 46 is diametrically penetrated through the internal slider 45, with its opposite ends radially extending through the respective associated slots 44, 44 and fitted through the inner peripheral wall of the external slider 18 slidably fitted on the drive shaft 13. Thus, the slider 18 is permanently urged toward the cylinder block 12 together with the internal slider 45 which is urged toward the cylinder block 12 by the coiled spring 31 as noted above, thereby permanently urging the wobble plate 20 in the angularity-decreasing direction.

Figure 5:
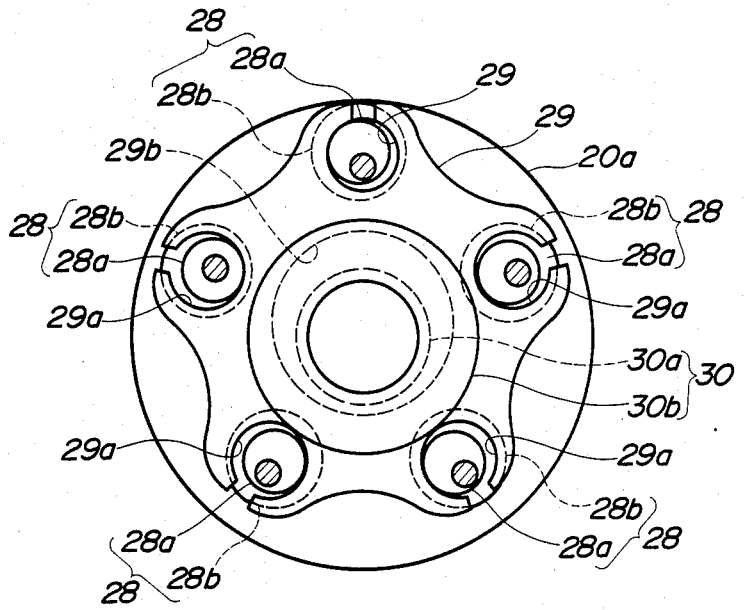
FIG. 5 is an end view taken along line V—V in FIG. 1.

On the other hand, the pistons 26 slidably received within the respective cylinders 14 formed in the cylinder block 12 are each provided with a piston rod 27 extending along its axis toward the wobble plate 20 and integrally formed at its tip with a sphere 27*a*. The spheres 27*a* spherically engage in spherical holes 28*a*′ formed in respective slipper shoes 28 each composed of a trunk portion 28*a* and a flanged portion 28*b* formed integrally with each other. The slipper shoes 28 are held in slidable contact or close proximity with the sliding side surface 20*a*′ of the rockingly rotating wobble plate 20 by means of a first retainer member 29, which is freely movable per se and engages the slipper shoes 28 for movement together therewith, as well as a second retainer member 30 which holds the first retainer member 29 in slidable contact or close proximity with the slipper shoes. More specifically, as best shown in FIG. 5, the first retainer member 29 is formed therein with five through bores 29*a* circumferentially arranged in the vicinity of its outer peripheral edge at locations corresponding to respective ones of the slipper shoes 28, each through bore 29*a* being slightly larger in diameter than the trunk portion 28*a* of its associated slipper shoe 28. The illustrated compressor is a five cylinder type. The first retainer member 29, in the form of a ring, is also formed therein with a central through bore 29*b* considerably larger in diameter than the drive shaft 13 and loosely fitted on the latter. The slipper shoes 28 have their trunk portions 28*a* loosely fitted in their respective through bores 29*a* of the first retainer member 29 and their flanged portions 28*b* disposed in slidable contact or close proximity with the same member 29, respectively, in such a manner that as the slipper shoes 28 slidingly move on the wobble plate, the first retainer member 29 is freely moved in directions substantially parallel to the sliding side surfaces of the wobble plate 20. The second retainer member 30 comprises an axially extending hollow tubular portion 30*a* loosely fitted in the central through bore 29*b* of the first retainer member 29 and also unremovably fitted in the central through bore 20*b* of the wobble plate 20 with its radially outwardly deformed hook 30*c* engaged by a stepped shoulder 20*b*′ formed on the central through bore 20*b* of the wobble plate 20, and a radially flanged portion 30*b* formed integrally on an end of the hollow tubular portion 30*a* and larger in diameter than the central through bore 29*b* of the first retainer member 29 but so small in diameter that it does not interfere with movement of the associated slipper shoes 28 on the wobble plate 20. The second retainer member 30 has its flanged portion 30*b* disposed to hold the first retainer member 29 in slidable contact or close proximity with the slipper shoes 28 while allowing an inner portion of the first retainer member 29 around its central bore to slide on the flanged portion 30*b*.

The side surface of the wobble plate 20 facing the pistons 26 is formed by a separately fabricated disc member 20*a* formed of a wear resisting material which is positioned radially by the hub 20*b* and prevented from rotation relative to the wobble plate 20 by mechanical means not shown, such as two diametrically opposite flat surfaces on the outer diameter of the hub 20*b* and two mating chordal surfaces formed in the through bore of the disc member 20*a*.

A valve plate 32 is disposed along an outer end face of the cylinder block 12, which carries thereon suction valves, not shown, and discharge valves 32*a* at locations corresponding to their respective cylinders 14. The suction valves are arranged between the cylinder bores and an annular suction chamber 33 formed in the cylinder head 11*b*, and the discharge valves 32*a* between the cylinder bores and an annular discharge chamber 34 formed in the same head 11*b*, respectively. The discharge chamber 34 is provided with a check valve 34*a* at its outlet, which is opened when the pressure in the chamber 34 exceeds a predetermined value, and the chamber 34 can communicate through the opened valve 34*a* with an outlet port formed in a discharge connector 34*b* which is to be connected to the refrigerating circuit, not shown, of the air conditioner.

An oil pump 35 for feeding lubricating oil to various sliding parts of the compressor is arranged in the cylinder block 12 at an extension of the axis of the drive shaft 13 and coupled to the rear end of the drive shaft 13 to be rotatively driven by the latter. The suction port 35*a* of the oil pump 35 is communicated with an oil sump 36 arranged at the bottom of the casing 11*a* through an oil passage 38 formed in the cylinder block 12 and an oil pipe 37 connected thereto, while the discharge port 35*b* of the oil pump 35 is connected to an oil passage, not shown, formed in the cylinder block 12 to feed lubricating oil to the sliding parts of the compressor.

A potentiometer 51, which forms sensor means for sensing the angularity of the wobble plate 20, is arranged in the cylinder head 11*b* at an extension of the axis of the drive shaft 13, and comprises a slider 51*a* urged toward the drive shaft 13 by springs 51*b* to be held in urging contact with the internal slider 45 through a rod 51*c* freely and axially slidably fitted through the small-sized axial hole 13*b* in the drive shaft 13. Thus, the slider 51*a* of the potentiometer 51 follows axial displacement of the internal slider 45.

Figure 6:
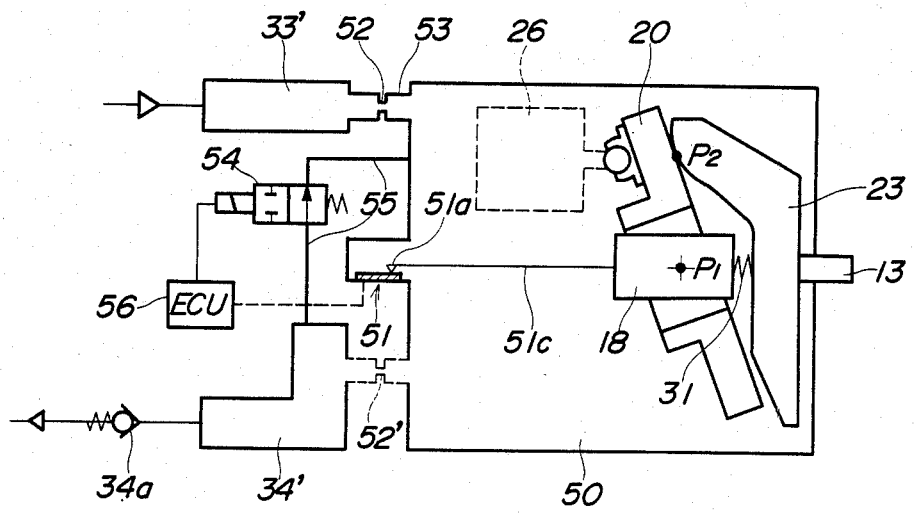
FIG. 6 is a block diagram of an example of the arrangement of a control system for the compressor.

FIG. 6 shows an example of the control system for controlling the compressor according to the invention. The interior of the crankcase 50 is communicated with a space 33' under a lower pressure (e.g. the suction chamber 33) by way of a passage 53 with an orifice 52 formed therein. The cross-sectional area of the orifice 2 is set at such a value as to permit blow-by gas leaking through the gaps between the cylinders 14 and the pistons 26 on compression strokes into the crankcase 50 to escape therefrom into the lower pressure space 33' (e.g. the suction chamber 33) at a flow rate at least slightly exceeding the maximum possible flow rate at which the blow-by gas leaks from the cylinders 14 into the crankcase 50. Therefore, by virtue of the orifice 52, the internal pressure of the crankcase 50 can be varied to control the angularity of the wobble plate under all operating conditions of the compressor, and continues to decrease anytime a solenoid-operated control valve, hereinafter referred to, is closed. In FIG. 6, the flow passage of the blow-by gas is shown in the form of an orifice 52'. The interior of the crankcase 50 is communicated with a space 34' under a higher pressure (e.g. the discharge chamber 34) by way of a passage 55 with a solenoid-operated control valve 54 disposed therein. The output of the potentiometer 51 is connected to the input of an electronic control unit 56 which in turn has its output connected to the solenoid of the control valve 54. The solenoid-operated control valve 54 is a normally opened type, and fully opens the passage 55 when the electronic control unit 56 commands deenergization of the solenoid, while it fully closes same when the solenoid is energized, that is, full closure is commanded by the electronic control unit 56.

The operation of the compressor according to the invention constructed as above will now be described. When the electronic control unit 56 is not providing electric power, the solenoid-operated control valve 54 is opened to communicate the interior of the crankcase 50 with the higher pressure space 34' through the passage 55. If on this occasion the compressor is at rest, the internal slider 18 is biased in the leftward position as viewed in FIG. 6 by the force of the coiled spring 31, and accordingly the wobble plate 20 is held in the minimum angularity position. If on this occasion the pulley 17 is rotated by the engine, not shown, the rotation is transmitted to the drive shaft 13 to cause rotation of the arm member 23 in unison with the drive shaft 13. The rotating arm member 23 causes rotation of the wobble plate 20 through the mutually engaging arm 23*a* and guide protuberances 20*e*, 20*e* on the wobble plate 20. As noted above, the rotating wobble plate 20 in its minimum angularity position causes the pistons to make reciprocating motions through a stroke length equal to several percent of the maximum stroke length. The stroking motions of the pistons cause a drop in the pressure in the lower pressure space 33', and simultaneously an increase in the pressure in the higher pressure space 34'. The pressure drop in the lower pressure space 33' is transmitted to the crankcase 50 through the orifice 52, while the pressure increase in the high pressure space 34' is also transmitted to the crankcase through the opened passage 55, so that the pressure in the crankcase 50 does not drop and acts upon the wobble plate 20 in the direction of the pistons 26. As shown in FIG. 3, on this occasion, the moment of the resultant force f2 of back pressures acting upon the pistons 26 or internal pressure in the crankcase 50 is balanced with the counteracting moment of the resultant reaction force f1 exerted by the pistons 26 and acting upon the wobble plate 20 in the direction away from the pistons, so that the wobble plate 20 is maintained in its minimum angularity position by the force of the spring 31, whereby the compressor is idling.

On the other hand, when the electronic control unit 56 is providing electric power, the solenoid-operated control valve 54 is closed to interrupt the communication between the interior of the crankcase 50 and the higher pressure space 34'. Then, a drop in the pressure in the lower pressure space 33' caused by stroke motions of the pistons 26 is transmitted through the orifice 52 into the crankcase 50 to cause a drop in the pressure in the crankcase 50, while simultaneously the pressure in the higher pressure space 34' increases, so that the moment of the resultant force f2 of back pressures acting upon the pistons 26 or internal pressure in the crankcase 50 drops below the moment of the resultant reaction force f1 to increase the angularity of the wobble plate 20 and accordingly increase the stroke length of the pistons 26, thereby increasing the capacity of the compressor. The check valve 34*a* aids startup by creating a small differential pressure which causes sufficient pressure increase in the higher pressure space 34' so that the wobble plate is moved significantly in the angularity increasing direction before the check valve 34*a* opens and allows flow from the compressor to the air conditioning system. The change of the angularity of the wobble plate 20 is transmitted to the slider 51*a* of the potentiometer 51 through the internal slider 45 axially moving in the axial hole 13*a* of the drive shaft 13 in response to the change of the angularity and the rod 51*c* moving together with the slider 45. An output signal from the potentiometer 51 indicative of the angularity of the wobble plate 20 is supplied to the electronic control unit 56 which in turn operates on the output signal from the potentiometer 51 and other parameters such as heat load on the air conditioner and the rotational speed of the engine to generate a control signal and supply same to the solenoid-operated control valve 54. More specifically, the electronic control unit 56 determines from the angularity of the wobble plate 20 indicated by the potentiometer 51 whether or not the capacity of the compressor corresponding to the angularity has reached a required value, and when the former has reached the latter, it causes the control valve 54 to be opened. Then, the interior of the crankcase 50 is communicated through the passage 55 with the higher pressure space 34' so that the high pressure in the higher pressure space 34' is introduced into the crankcase 50 to interrupt the decrease of the pressure in the crankcase 50 to thereby interrupt the increase of the angularity of the wobble plate 20. The introduction of the high pressure into the crankcase 50 causes an increase in the crankcase pressure, which causes a decrease in the angularity of the wobble plate 20. This angularity decrease is sensed by the potentiometer 51, and accordingly the electronic control unit 56 causes the control valve 54 to be closed to interrupt the communication between the interior of the crankcase 50 and the higher pressure space 34'. Consequently, the crankcase pressure only undergoes leakage through the orifice 52 into the lower pressure space 33' to decrease so that the angularity of the wobble plate 20 is increased. The above operation is repeated to control the capacity of the compressor to values corresponding to heat load on the air conditioner.

If the capacity of the compressor rises above or drops below a value required for the heat load on the air conditioner due to an increase or a decrease in the rotational speed of the engine, or due to a decrease or an increase in the heat load, the electronic control unit 56 operates to open or close the control valve 54 for control of the angularity of the wobble plate or the capacity of the compressor. That is, when the capacity of the compressor increases above a value required for the heat load on the air conditioner, the crankcase pressure is increased to decrease the angularity of the wobble plate 20, whereas when the compressor capacity decreases below such a value, the crankcase pressure is decreased to increase the angularity of the wobble plate.

Now, if it is desired to apply all the output from the engine to driving of the vehicle at acceleration of the vehicle, running of the vehicle on an ascent, etc., the electronic control unit 56 stops providing electric power so that the control valve 54 is opened to promptly introduce the higher pressure from the higher pressure space 34' into the crankcase 50 through the passage 55. Then, the crankcase pressure is quickly elevated to cause prompt displacement of the wobble plate 20 to its minimum angularity position, whereby the compressor comes into an idling state. As a consequence, part of the engine output otherwise consumed by the compressor is also applied to driving of the vehicle to thereby enhance the accelerability of the vehicle, the ability of same to run up an ascent, etc.

Further, according to the invention, under all operating conditions of the compressor, blow-by gas leaking into the crankcase 50 through gaps between the cylinders 14 and the pistons 26 is always allowed to flow into the lower pressure space 33' through the orifice 52 which has a sufficient cross-sectional area so that if the control valve 54 is closed during operation of the compressor, the crankcase pressure will always decrease. Therefore, the control of the crankcase pressure can be achieved merely by controlling the solenoid-operated control valve 54 alone to thereby control the communication between the high pressure space 34' and the crankcase 50.

Further in the compressor, the second fulcrum P2 for the wobble plate 20 is formed by the side surface 20*a*'' of the wobble plate 20 remote from the cylinder block 12 and the end surface of the arm 23*b* of the arm member 23 engaging therewith. With an increase in the angularity of the wobble plate 20, the second fulcrum P2 is displaced in the direction of the axis C of the drive shaft 13 toward the position P2'. Consequently, the moment of the resultant force f2 (the resultant force of back pressures upon the pistons 26 or internal pressure in the crankcase 20, which acts upon the wobble plate 20 in the direction of the pistons 26) and the moment of the resultant force f1 (the resultant reaction force exerted by the pistons 26 on compression and suction strokes and acting upon the wobble plate 20 in the direction away from the pistons 26) with respect to the second fulcrum P2 decreases as the angularity of the wobble plate 20 increases. That is, the rate of change of the angularity of the wobble plate decreases relative to a change in the crankcase pressure, thereby increasing the probability of achieving stable control of the capacity of the compressor.

Moreover, as noted before, the positions of the first and second fulcrums P1, P2 are set such that the pistons 26 start their stroke or reciprocating motions from their extreme end or top dead center positions in their respective cylinders 14, irrespective of the angularity of the wobble plate then assumed. This means that the clearance volume of each cylinder is very small even when the wobble plate assumes a very small angularity and accordingly the capacity of the compressor is very small, thereby always ensuring sufficient compression efficiency.

Figure 7:
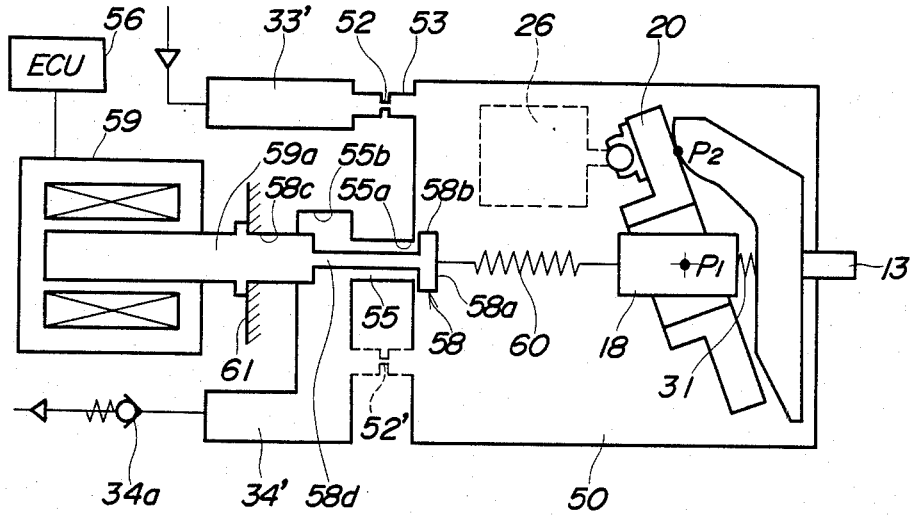
FIG. 7 is a block diagram of another example of the arrangement of the control system for the compressor according to the present invention.

FIG. 7 shows another example of the control system for the compressor according to the invention. This control system is an internal feedback type, as distinct from the control system of the previous embodiment which is an external feedback type. In FIG. 7, corresponding elements to those in FIG. 6 are designated by identical reference numerals and symbols. According to the present embodiment, a solenoid-operated control valve 58 of the poppet type is arranged in the crankcase 50 and has its valve poppet 58*a* disposed opposite an end 55*a* of the passage 55 opening in the crankcase 50 to selectively close and open same. The valve poppet 58*a* is coupled via a rod 58*d* to a movable core 59*a* movable axially with the valve poppet 58*a* and relative to a solenoid 59. Connected to the valve poppet 58*a* is one end of a feedback spring 60 which is formed by a tension spring and coupled at the other end to the slider 18 of the compressor. Thus, the valve poppet 58*a* is pulled by the feedback spring 60 in a direction of opening the above end 55*a* of the passage 55. An end portion of the movable core 59*a* closer to the valve poppet 58*a* opens in an enlarged portion 55*b* of the passage adjacent a portion thereof including the end 55*a*, while the other end portion and intermediate portion of the movable core 59*a* are inserted into the solenoid 59. A stopper 61 is formed integrally on the movable core 59*a* to hold same in an extreme position very close to the other extreme or fully "pulled in" position which can be assumed during energization of the solenoid 59, thus setting a maximum value of the valve opening of the control valve 58 (i.e. valve poppet 58*a*). Therefore, the movable core 59*a* is displaceable through a very small stroke between the two extreme positions so that the solenoid 59 would operate with only a very short stroke of the movable core 59*a* at a position very close to the fully "pulled in" position thereof, and accordingly the valve poppet 58*a* combined with the movable core 59*a* is displaceable through the same small stroke between its open position and its closed position.

An electronic control unit 56 is connected to the solenoid 59 so that the latter is energized or deenergized in response to an output control signal from the former. The electronic control unit 56 is connected with the power switch, not shown, of the air conditioner for operation in response to closing and opening thereof, such that the solenoid 59 is kept energized all the time during operation of the air conditioner. During operation of the air conditioner, the control valve 58 or valve poppet 58*a* opens and closes in response to changes in the pulling force of the feedback spring 60 or to changes in the solenoid current which is controlled by the electronic control unit 56. It is intended that the valve 58 will only assume either a fully open position or a fully closed position and will not assume an intermediate position.

The diameter 58*c* of the aforementioned end portion of the movable core 59*a* closer to the valve poppet 58*a* is less than the diameter 58*b* of the valve poppet 58*a* (which is greater than the inside diameter of the end 55*a* of the passage 55) and greater than the inside diameter of the end portion 55*a* of the passage 55 and selected to minimize the pressure forces that exert axial loads on the valve body 58 in order to minimize the magnitude of the control forces required of the feedback spring 60 and the solenoid 59 and to make the valve relatively insensitive to the difference in pressure between the crankcase 50 and the higher pressure space 34' .

According to the present control system arranged as above, when the electronic control unit 56 is not providing electric power so that the solenoid 59 is in a deenergized state, the control valve 58 is biased in its maximum valve opening position. In this position, if the compressor is driven by the engine, discharge gas produced by small stroke motions of the pistons 26 and delivered into the higher pressure space 34' is introduced into the crankcase 50 to keep the crankcase pressure from decreasing so that the wobble plate 20 assumes its minimum angularity position to keep the compressor in an idling state. Then, if the electronic control unit 56 energizes the solenoid 59, e.g. when the power switch 57 of the air conditioner is closed, the valve poppet 58*a* of the control valve 58 is displaced to its closed position against the force of the feedback spring 60. Accordingly, the communication between the crankcase 50 and the higher pressure space 34' is interrupted, while simultaneously there occurs a drop in the lower pressure space 33' with small stroke motions of the pistons 26. This pressure drop is transmitted through the orifice 52 into the crankcase 50 to cause a drop in the crankcase pressure. At the same time, there occurs an increase in the pressure of the higher pressure space 34' with stroke motions of the pistons 26, thereby causing a gradual increase in the angularity of the wobble plate 20. The check valve 34*a* aids startup by creating a small differential pressure which causes sufficient pressure increase in the higher pressure space 34' so that the wobble plate is moved significantly in the angularity increasing direction before the check valve opens and allows flow from the compressor to the air conditioning system.

With this increase of the angularity of the wobble plate 20, the slider 18 is displaced in the direction of the feedback spring 60 being expanded. The resulting increased pulling force of the feedback spring 60 causes the valve 58 to open to allow compressed gas to flow from the high pressure space 34' into the crankcase 50. Consequently, the crankcase pressure increases to cause a decrease in the angularity of the wobble plate 20. This in turn causes the pulling force of the spring 60 to decrease sufficiently to allow the valve 58 to close, thereby causing a decrease in the crankcase pressure. In this manner, the wobble plate 20 assumes a value of angularity corresponding to the crankcase pressure thus controlled, and the compressor operates with a capacity corresponding to the angularity assumed by the wobble plate 20.

The control of the compressor capacity can be performed in a continuous manner responsive to changes in the rotational speed of the engine, the heat load on the air conditioner etc., by varying the degree of energization of the solenoid 59, that is, the electric current value applied to the solenoid 59 by the electronic control unit 56. If it is desired to apply all the engine output to driving of the vehicle, the electronic control unit 56 interrupts the supply of electric current to the solenoid. Then, in the same manner as in the previous embodiment, the higher pressure in the higher pressure space 34' is promptly introduced into the crankcase 50 through the passage 55 to cause a prompt rise in the crankcase pressure and accordingly prompt displacement of the wobble plate 20 to its minimum angularity position, whereby the compressor comes into an idling state to allow application of part of the engine output to be consumed by the compressor to driving of the vehicle.

The above described embodiment of FIG. 7 has the advantage that the poppet-type solenoid valve 58 has a very short stroke to utilize the high solenoid forces that are developed at near the fully pulled-in position, so a small relatively low-cost solenoid can be used.

As described above, the wobble plate compressor according to the invention is arranged such that the control of the angularity of the wobble plate or the capacity of the compressor is effected by introducing high pressure from a higher pressure space into the crankcase of which the pressure is permanently leaked into a lower pressure space. Therefore, the crankcase pressure can be promptly increased to obtain prompt cutting-off of the operation of the compressor, particularly when it is desired to apply all the output from the engine to driving of the vehicle at acceleration of the vehicle, running of same on an ascent, etc.

Moreover, the introduction of high pressure into the crankcase is effected by a single valve means having a simple structure, facilitating the control of the compressor capacity and reducing the manufacturing cost.

While a preferred embodiment has been described, variations thereto will occur to those skilled in the art within the scope of the present inventive concepts which are delineated by the following claims.

What is claimed is:

1. A variable capacity wobble plate compressor comprising: a housing defining therein a crankcase, a lower pressure space, and a higher pressure space; a drive shaft rotatably disposed in said housing; a cylinder block arranged in said housing and defining therein a plurality of cylinders circumferentially arranged around said drive shaft and extending substantially parallel to the axis of said drive shaft, each of said cylinders having an interior thereof disposed for communication with said lower pressure space and said higher pressure space; pistons received in respective ones of said cylinders for reciprocating motions therein; said crankcase having an interior thereof disposed to be supplied with blow-by gas from said cylinders when said pistons thereof are on compression and suction strokes; a wobble plate arranged in said crankcase and pivotally and slidably fitted on said drive shaft for rotation together therewith, said pistons engaging said wobble plate for reciprocating motions in said respective ones of said cylinders as said wobble plate rotates; a pivot forming a first fulcrum supporting said wobble plate at a diametrically central location thereof and axially movable along said drive shaft; and an arm member rotatable together with said drive shaft about the axis of said drive shaft, said arm member forming a second fulcrum supporting said wobble plate at a location radially spaced from said drive shaft, whereby said second fulcrum is rotatable about the axis of said drive shaft together with said arm member; said wobble plate having an angle of axial inclination thereof relative to said drive shaft variable about said second fulcrum for varying displacement of said pistons in response to the difference between resultant reaction force exerted by said pistons on compression strokes thereof and pressure in said crankcase acting upon said pistons as back pressure; a first passage having an orifice and communicating said lower pressure space with the interior of said crankcase for permitting escape of internal pressure in the latter into the former; a second passage communicating said higher pressure space with the interior of said crankcase for introducing internal pressure in the former to the latter; and a control valve means for controlling the opening of said second passage.

2. A variable capacity wobble plate compressor as claimed in claim 1 including elastic means permanently urging said wobble plate in an angularity-decreasing direction thereof.

3. A variable capacity wobble plate compressor as claimed in claim 2, wherein said elastic means comprises a coiled spring disposed in an axial hole formed in said drive shaft, a first slider slidably fitted in said axial hole and urged by said coiled spring, a second slider slidably fitted on said drive shaft and supporting said pivot thereon, and a joining means joining said first and second sliders together for movement thereof in unison axially along said drive shaft.

4. A variable capacity wobble plate compressor as claimed in claim 1, wherein said orifice of said first passage has a cross-sectional area thereof set at such a value as to permit blow-by gas leaking into said crankcase to escape from said crankcase into said lower pressure space at a flow rate at least slightly exceeding the maximum possible flow rate at which said blow-by gas leaks from said cylinders into said crankcase.

5. A variable capacity wobble plate compressor as claimed in claim 1 or claim 4, wherein said control valve means comprises an electromagnetic valve disposed to selectively close and open said second passage and having a solenoid, said electromagnetic valve being responsive to the state of energization of said solenoid to selectively assume a position in which it fully closes said second passage and a position in which it fully opens same; a sensor means for sensing the angularity of said wobble plate; and an electronic control means for producing a control signal for controlling the state of energization of said solenoid in response to an output signal from said sensor means and signals indicative of predetermined parameters.

6. A variable capacity wobble plate compressor as claimed in claim 5, wherein said sensor means comprises a potentiometer displaceable in response to tilting movement of said wobble plate for producing a signal having a value corresponding to the angularity position of said wobble plate.

7. A variable capacity wobble plate compressor as claimed in claim 1 or claim 4, wherein said control valve means comprises an electromagnetic valve disposed to selectively close and open said second passage and having a solenoid, said electromagnetic valve being disposed to be displaced in a closing direction thereof when said solenoid is energized; a feedback means for mechanically biasing said electro-magnetic valve in an opening direction thereof against the electromagnetic force of said solenoid, said feedback means having a mechanical biasing force thereof variable in response to the angularity of said wobble plate; and an electronic control means for controlling said solenoid, said electronic control means being adapted to produce a control signal for always keeping said solenoid energized during operation of said compressor while varying the degree of energization of said solenoid in response to signals indicative of predetermined parameters, whereby said electro-magnetic valve assumes either a fully opened position or a fully closed position in response to the biasing force of said feedback means and the degree of energization of said solenoid.

8. A variable capacity wobble plate compressor as claimed in claim 7, wherein said feedback means comprises a tension spring connected between said pivot of said wobble plate and said electromagnetic valve for having a tensile force thereof increased with an increase in the angularity of said wobble plate.

9. A variable capacity wobble plate compressor as claimed in claim 7, including elastic means permanently urging said wobble plate in an angularity-decreasing direction thereof.

10. A variable capacity wobble plate compressor as claimed in claim 7, wherein said second passage has one end portion opening in said crankcase, said electromagnetic valve comprising a valve poppet arranged in said crankcase and disposed opposite said one end portion of said second passage for selectively closing and opening same, said feedback means being connected to said valve poppet, a movable core combined with said valve poppet for axial movement therewith, said movable core being inserted into said solenoid for displacement in response to the state of energization thereof, and a stopper for setting a maximum value of opening of said valve poppet, said movable core being displaceable between a first extreme position wherein it is fully pulled in said solenoid and a second extreme position limited by said stopper and very close to said first extreme position.

11. A variable capacity wobble plate compressor as claimed in claim 10, wherein said second passage has a second portion larger in inside diameter than said one end portion thereof, said movable core having one end portion closer to said valve poppet and opening in said second portion of said second passage, said valve poppet having a diameter larger than the inside diameter of said one end portion of said second passage, said one end portion of said movable core having a diameter smaller than the diameter of said valve poppet and larger than the inside diameter of said one end portion of said second passage and selected to minimize pressure forces that exert axial loads on said electro-magnetic valve.

* * * * *